US011281142B2

(12) United States Patent
Zhang et al.

(10) Patent No.: US 11,281,142 B2
(45) Date of Patent: Mar. 22, 2022

(54) FIXING DEVICE WITH SUPPORTED SIDE GUIDE

(71) Applicant: BROTHER KOGYO KABUSHIKI KAISHA, Nagoya (JP)

(72) Inventors: Mingguang Zhang, Nagoya (JP); Tatsuo Ogasawara, Kasugai (JP); Kenji Takeuchi, Nagoya (JP); Tokifumi Tanaka, Komaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/120,945

(22) Filed: Dec. 14, 2020

(65) Prior Publication Data

US 2021/0200131 A1 Jul. 1, 2021

(30) Foreign Application Priority Data

Dec. 27, 2019 (JP) ..... JP2019-238930
Jul. 27, 2020 (JP) ..... JP2020-126230

(51) Int. Cl.
*G03G 15/20* (2006.01)

(52) U.S. Cl.
CPC ..... *G03G 15/2064* (2013.01); *G03G 15/206* (2013.01); *G03G 15/2032* (2013.01); *G03G 2215/00143* (2013.01); *G03G 2215/00151* (2013.01); *G03G 2215/2009* (2013.01)

(58) Field of Classification Search
CPC ..... G03G 15/2064; G03G 15/206; G03G 2215/2009; G03G 2215/2035; G03G 15/2032; G03G 15/2035; G03G 2215/00143; G03G 2215/00151
See application file for complete search history.

(56) References Cited

U.S. PATENT DOCUMENTS

2008/0292374 A1 11/2008 Hiraoka et al.
2014/0212189 A1 7/2014 Kondo
2015/0098736 A1* 4/2015 Furukata ..... G03G 15/2032 399/329
2016/0231676 A1 8/2016 Ishida et al.
2018/0224777 A1* 8/2018 Hashimoto ..... G03G 15/2053
2018/0284668 A1* 10/2018 Lee ..... G03G 21/1647
(Continued)

FOREIGN PATENT DOCUMENTS

JP 2008-292793 A 12/2008
JP 2014-149361 A 8/2014
JP 2016-145902 A 8/2016

*Primary Examiner* — Walter L Lindsay, Jr.
*Assistant Examiner* — Laura Roth
(74) *Attorney, Agent, or Firm* — Merchant & Gould P.C.

(57) ABSTRACT

In a fixing device, a pressure unit is pressed toward a roller by an arm, to form a nip region. The pressure unit includes a belt configured to contact the roller in a nip region, a pressure pad configured to press the belt in combination with the roller, and a side guide including an end guide surface configured to guide a side end of the belt, and a stay configured to support the pressure pad. A supporting member is located on an outer side of the side guide that is opposite to an inner side on which the end guide surface faces. The supporting member is held between the stay and the arm, the supporting member comprising a contact surface which contacts the side guide and on which the side guide is swayably supported.

20 Claims, 12 Drawing Sheets

(56) References Cited

U.S. PATENT DOCUMENTS

| | | | | |
|---|---|---|---|---|
| 2020/0272079 | A1* | 8/2020 | Taguchi | G03G 15/2053 |
| 2020/0310312 | A1* | 10/2020 | Taguchi | G03G 15/2053 |
| 2020/0310313 | A1* | 10/2020 | Handa | G03G 15/2053 |
| 2020/0310314 | A1* | 10/2020 | Handa | G03G 15/757 |
| 2021/0011406 | A1* | 1/2021 | Zhang | G03G 15/2053 |

* cited by examiner

FIXING DEVICE WITH SUPPORTED SIDE GUIDE

CROSS-REFERENCE TO RELATED APPLICATION(S)

This application claims priority from Japanese Patent Application No. 2019-238930 filed on Dec. 27, 2019 and Japanese Patent Application No. 2020-126230 filed on Jul. 27, 2020, the disclosures of which are incorporated herein by reference in their entirety.

TECHNICAL FIELD

Apparatuses disclosed herein relate to a fixing device for fixing a developer image on a sheet.

BACKGROUND ART

A fixing device hitherto known in the art comprises a heating roller, a belt, a pressure member, a pressure arm, and a side guide. The pressure member is configured to hold the belt in combination with the heating roller, and the belt is held between the heating roller and the pressure member. The pressure arm is configured to bias the pressure member toward the heating roller. The side guide is configured to guide a side end and an inside surface of the belt. The side guide may comprise a protrusion protruding toward the pressure arm. This side guide is thus swayable relative to the pressure arm on the protrusion as a supporting point.

SUMMARY

The side guide is typically made of a material softer than a material of the pressure arm. Therefore, the protrusion of the side guide is subject to wear with the use of the fixing device. If the protrusion is worn down, the side guide needs replacing. When the side guide is removed from the belt for replacement, grease on the inside surface of the belt is stripped off, partly taken away with the side guide and reduced. Reduction of the grease on the inside surface of the belt caused in this way would disadvantageously alter the easy-to-slide property of the inside surface of the belt, thus making it necessary to supply a grease deficiency.

In view of the circumstances, it would be desirable to provide a fixing device which can obviate the necessity for replacement of the side guide after wearing down of the protrusion serving as a supporting point of the swaying motion of the side guide.

In one aspect, a fixing device is disclosed herein which comprises a roller, a pressure unit, an arm and a supporting member. The pressure unit is configured to form a nip in combination with the roller. The pressure unit comprises a belt, a pressure pad, a side guide, and a stay. The belt is configured to contact the roller in a nip region. The pressure pad is configured to press the belt in combination with the roller. The side guide comprises an end guide surface. The end guide surface is configured to guide a side end of the belt. The stay is configured to support the pressure pad. The arm is configured to press the pressure unit toward the roller. The supporting member is located on an outer side of the side guide that is opposite to an inner side on which the end guide surface faces. The supporting member is held between the stay and the arm. The supporting member comprises a contact surface which contacts the side guide and on which the side guide is swayably supported.

With this configuration, the contact surface, once worn out, can be renewed by replacing the supporting member only, without removing the side guide from the belt; thus, the side guide would not need replacing. Therefore, the reduction of grease as would otherwise be entailed by removal of the side guide for replacement, and the resulting alteration of the easy-to-slide property of the inside surface of the belt can be restrained.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

Figure 1:
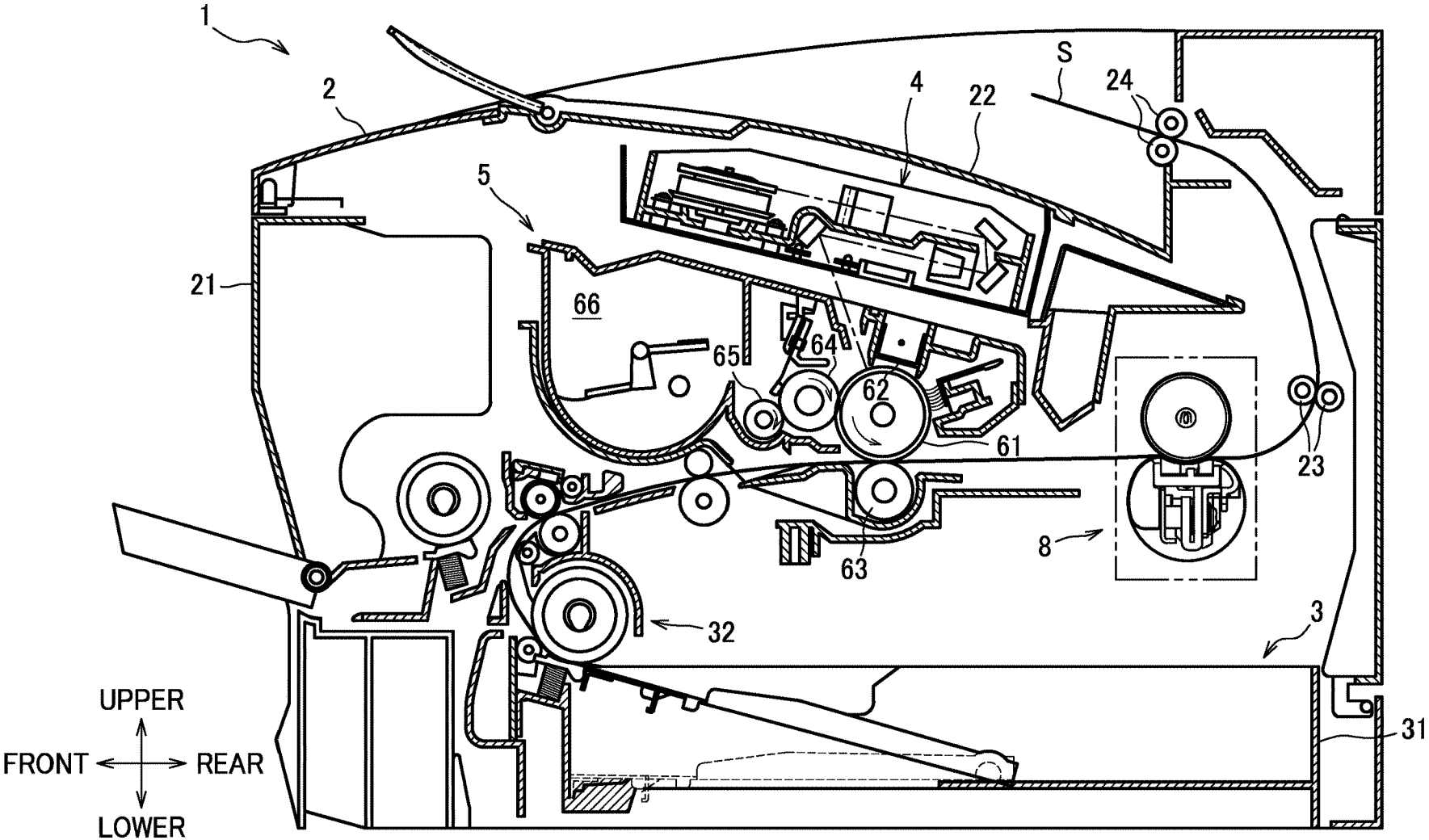
FIG. 1 is a section view of an image forming apparatus.

As shown in FIG. 1, a fixing device 8 illustrated herein is a device used in an image forming apparatus 1 such as a laser printer. The image forming apparatus 1 comprises a housing 2, a sheet feeder unit 3, an exposure device 4, a developer image forming unit 5, and the fixing unit 8.

The sheet feeder unit 3 is provided in a lower space inside the housing 2, and comprises a sheet tray 31 as a receptacle for holding and serving sheets S (e.g., of paper), and a sheet feed mechanism 32. Sheets S in the sheet tray 31 are fed on a one-by-one basis by the sheet feed mechanism 32 to the developer image forming unit 5.

The exposure device 4 is provided in an upper space inside the housing 2, and comprises a light source device (not shown), and a polygon mirror, lenses and reflectors (shown without reference characters). The exposure device 4 is configured to rapidly scan a surface of a photoconductor drum 61 with a light beam (see alternate long and short dashed lines) emitted from the light source device in accordance with image data, to thereby expose the surface of the photoconductor drum 61 to the light beam.

The developer image forming unit 5 is provided under the exposure device 4. The developer image forming unit 5 is configured as a process cartridge, installable into and removable from the housing 2 through an opening which is made available when a front cover 21 attached at a front side of the housing 2 is opened. The developer image forming unit 5 comprises a photoconductor drum 61, a charger 62, a transfer roller 63, a development roller 64, a supply roller 65, and a developer container 66 in which developer composed of dry toner is held.

In the developer image forming unit 5, the surface of the photoconductor drum 61 is uniformly charged by the charger 62. Thereafter, the surface of the photoconductor drum 61 is scanned with a light beam from the exposure device 4, and selectively exposed to light so that an electrostatic latent image formulated in accordance with the image data is formed on the surface of the photoconductor drum 61. Developer in the developer container 66 is supplied via the supply roller 65 to the development roller 64.

In the developer image forming unit 5, developer on the development roller 64 is supplied to the electrostatic latent image formed on the surface of the photoconductor drum 61. Accordingly, the electrostatic latent image is visualized, and a developer image is formed on the surface of the photoconductor drum 61. Thereafter, a sheet S fed from the sheet feeder unit 3 is conveyed through between the photoconductor drum 61 and the transfer roller 63, so that the developer image on the surface of the photoconductor drum 61 is transferred to the sheet S. In this way, the developer image is formed on the sheet S.

The fixing device 8 is provided rearward of the developer image forming unit 5. The features of the fixing device 8 will be described later in detail. The fixing device 8 causes a sheet S with a developer image transferred (formed) thereon to pass therethrough, and thereby thermally fixes the developer image on the sheet S. The image forming apparatus 1 further comprises an output tray 22, conveyor rollers 23 and ejection rollers 24. The output tray 22 is provided outside of the housing 2. The sheet S with the developer image thermally fixed thereon is ejected by the conveyor rollers 23 and the ejection rollers 24 onto the output tray 22.

Figure 2:
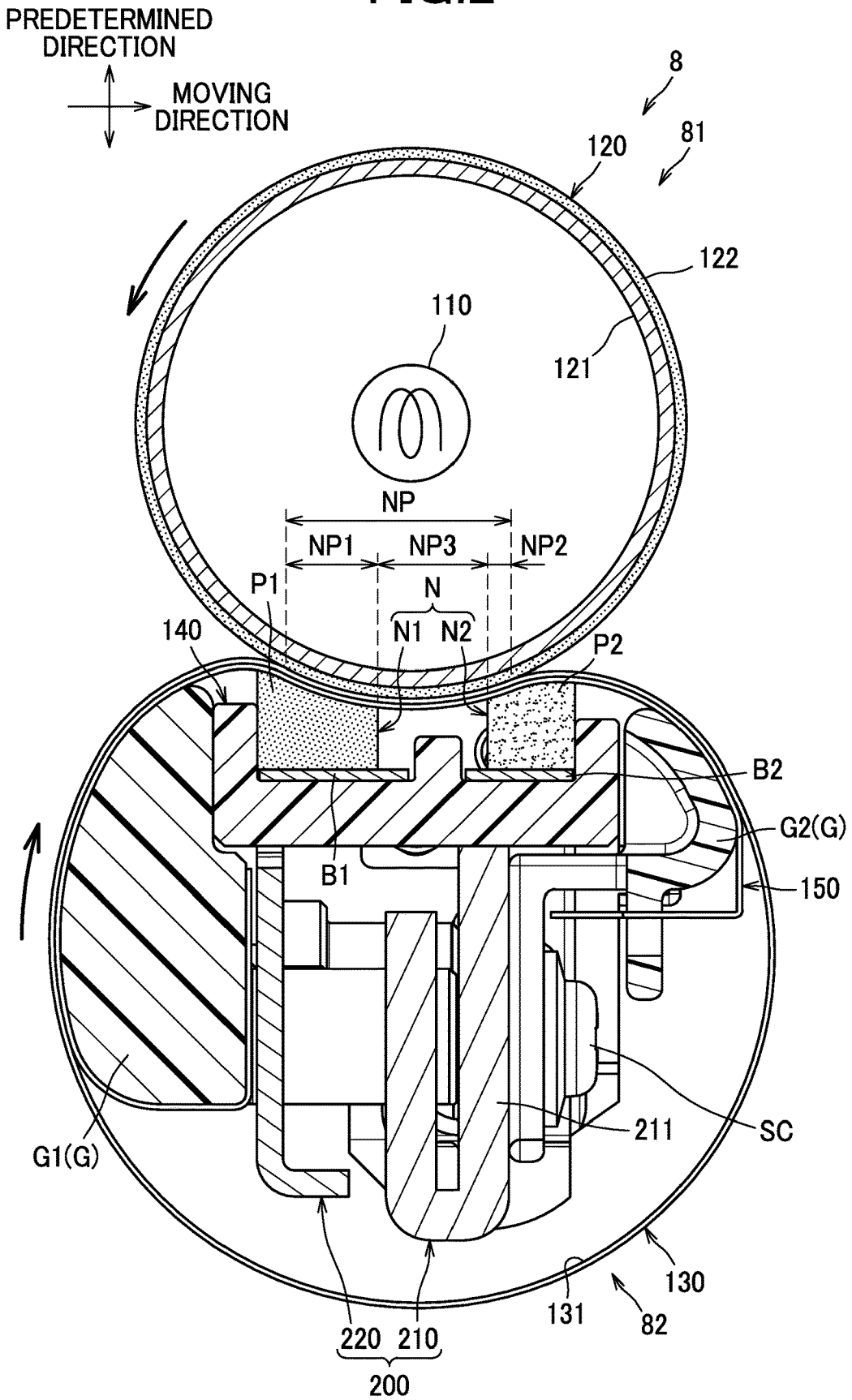
FIG. 2 is a section view of a fixing device.

As shown in FIG. 2, the fixing device 8 comprises a heater 110, a first fixing member 81, a second fixing member 82, and a biasing mechanism 300A (see FIG. 4) of which a detailed description will be given later. The second fixing member 82 is biased toward the first fixing member 81 by the biasing mechanism 300A. In the following description, the direction in which the second fixing member 82 is biased toward the first fixing member 81 is referred to as "predetermined direction". The predetermined direction herein is, but not limited to, a direction perpendicular to a width direction and to a moving direction. The "width direction" and "moving direction" will be described below. In other words, the predetermined direction is an orientation aligned parallel to directions in which the first fixing member and the second fixing member face each other.

The first fixing member 81 includes a roller 120 that is rotatable. The second fixing member 82 as an example of a pressure unit is a member configured to form a nip (nip region NP) in combination with the roller 120. The nip region NP is formed between first fixing member 81 and the second fixing member 82. To be more specific, the nip region NP is formed between the roller 120 and the second fixing member 82. The second fixing member 82 includes a belt 130, a nip-forming member N, a holder 140, a stay unit 200, a belt guide G, and a slide sheet 150. In this description, the direction of the width of the belt 130 is simply referred to as "width direction". The width direction coincides with a direction of extension of an axis of rotation of the roller 120, that is, an axial direction of the roller 120. The width direction is perpendicular to the predetermined direction.

The heater 110 comprises a halogen lamp which, when energized, generates light and heat. The heater 110 applies its radiant heat to the roller 120 to cause the roller 120 to heat up. The heater 110 is disposed inside the roller 120 along the axis of rotation of the roller 120.

The roller 120 has a shape of a long tube with its length (axis of rotation) oriented parallel to the width direction, and is heated by the heater 110. The roller 120 comprises a tube blank 121 made of metal or the like, and an elastic layer 122 with which the tube blank 121 is covered. The elastic layer 122 is made of rubber, such as silicone rubber. The roller 120 is rotatably supported by side frames 83 (see FIG. 4) which will be described later. Driving force received from a motor (not shown) provided in the housing 2 causes the roller 120 to rotate in a counterclockwise direction of FIG. 2.

The belt 130 is a member having a shape of a long tube (i.e., endless belt), that is, a tubular member with flexibility. The belt 130, though not illustrated, comprises a base made of metal, plastic or the like, and a release layer with which an outside surface of the base is covered. The belt 130 is configured to contact the roller 120 in the nip region NP. The belt 130 is caused to rotate by friction with the roller 120 or the sheet S in the clockwise direction of FIG. 2 according as the roller 120 rotates. A lubricant, such as grease, is put on an inside surface 131 of the belt 130. Inside of the belt 130, the nip-forming member N, the holder 140, the stay unit 200, the belt guide G, and the slide sheet 150 are disposed.

In other words, the nip-forming member N, the holder 140, the stay unit 200, the belt guide G, and the slide sheet 150 as a whole are surrounded and covered with the belt 130.

Figure 3:
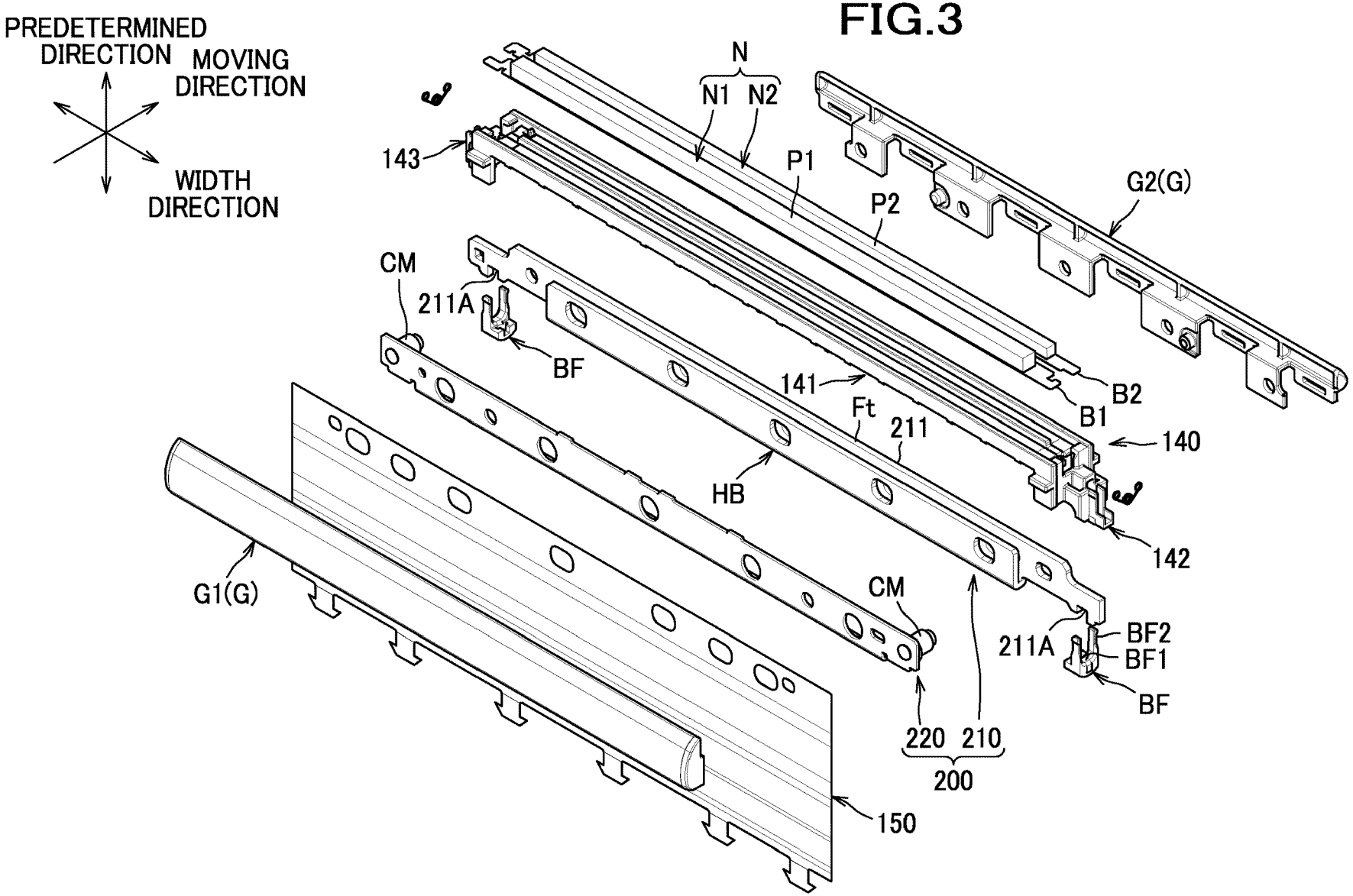
FIG. 3 is an exploded perspective view showing members arranged inside a belt.

As shown in FIG. 2 and FIG. 3, the nip-forming member N is a member configured as a pressure pad to press the belt 130 in combination with the roller 120 to form a nip region NP in combination with the roller 120 by holding the belt 130 between the roller 120 and the nip-forming member N. The nip-forming member N comprises an upstream nip-forming member N1 and a downstream nip-forming member N2.

The upstream nip-forming member N1 comprises an upstream pad P1 and an upstream fastening plate B1. The upstream pad P1 is a rectangular parallelepiped member. The upstream pad P1 is made of rubber, such as silicone rubber. The upstream pad P1 and the roller 120 hold the belt 130 therebetween to form an upstream nip region NP1.

In this description, the direction of motion of the belt 130 at the upstream nip region NP1, or the nip region NP of which a detailed description will be given later, is simply referred to as "moving direction". The moving direction should in actuality vary gradually with the curved contour of the periphery (outer cylindrical surface) of the roller 120, but is herein illustrated as a direction perpendicular to the predetermined direction and to the width direction, because this direction is substantially the same direction as the direction perpendicular to the predetermined direction and to the width direction. It is to be understood that the moving direction is the same direction as a direction of conveyance of a sheet S at the nip region NP.

The upstream pad P1 is fixed to (particularly, on a roller 120 side surface of) the upstream fastening plate B1. The upstream fastening plate B1 is made of a material harder than that of the upstream pad P1. For example, the upstream fastening plate B1 may be made of metal.

The downstream nip-forming member N2 is located downstream in the moving direction of and apart from the upstream nip-forming member N1. The downstream nip-forming member N2 comprises a downstream pad P2 and a downstream fastening plate B2. The downstream pad P2 is a rectangular parallelepiped member. The downstream pad P2 is made of rubber, such as silicone rubber. The downstream pad P2 and the roller 120 hold the belt 130 therebetween to form a downstream nip region NP2. The downstream pad P2 is located apart from the upstream pad P1 in a direction of rotation (or the moving direction) of the belt 130.

Accordingly, between the upstream nip region NP1 and the downstream nip region NP2, there exists an intervening nip region NP3 on which no pressure is directly exerted from the second fixing member 82. In this intervening nip region NP3, the belt 130 is in contact with the roller 120, but almost no pressure is applied because there is no counterpart member which holds the belt 130 in combination with the roller 120. Therefore, when a sheet S conveyed through between the roller 120 and the belt 130 passes through the intervening nip region NP3, the sheet S is subjected to heat from the roller 120 but not subjected to pressure. In this description, the whole region from an upstream end of the upstream nip region NP1 to a downstream end of the downstream nip region NP2, i.e., the whole region in which the outside surface of the belt 130 and the roller 120 contacts each other is referred to as "nip region NP". In other words, in this example, the nip region NP covers a region on which pressing forces from the upstream pad P1 and the downstream pad P2 are not exerted.

The downstream pad P2 is fixed to (particularly, on a roller 120 side surface of) the downstream fastening plate B2. The downstream fastening plate B2 is made of a material harder than that of the downstream pad P2. For example, the downstream fastening plate B2 may be made of metal.

The upstream pad P1 has a hardness greater than a hardness of the elastic layer 122 of the roller 120. The downstream pad P2 has a hardness greater than a hardness of the upstream pad P1.

The hardness herein refers to durometer hardness as specified in ISO 7619-1. The durometer hardness is a value determined from the depth of an indentation in a test piece created by the standardized indenter under specified conditions. For example, where the elastic layer 122 has a durometer hardness of 5, it is preferable that the upstream pad P1 have a durometer hardness in a range of 6 to 10, and the downstream pad P2 have a durometer hardness in a range of 70 to 90.

The holder 140 is a member that supports the nip-forming member N. The holder 140 is made of plastic or other material having a heat-resisting property. The holder 140 comprises a holder base 141 and two engagement portions 142, 143.

The holder base 141 is a portion that holds the nip-forming member N. The holder base 141 is mostly located within a space covered by the belt 130 so as not to protrude outward from the inside of the belt 130 in the width direction. The holder base 141 includes two end portions positioned near the open sides of the belt 130 (tubular endless belt) which open outward in the width direction. The holder base 141 is supported by the stay unit 200.

The engagement portions 142, 143 are provided at the end portions of the holder base 141. Each of the engagement portions 142, 143 extends from the corresponding end portion of the holder base 141 outward in the width direction. The engagement portions 142, 143 are located outside the space covered by the belt 130 (at the outsides of the open sides of the belt 130 which open outward in the width direction). The engagement portions 142, 143 are engaged with respective end portions of a first stay 210 which will be described below. Specifically, the end portions of the first stay 210 with which the engagement portions 142, 143 are engaged are positioned near the open sides, which open outward in the width direction, of the tubular endless belt 130.

The stay unit 200 is a member located across the holder 140 from the nip-forming member N to support the holder 140. In other words, the stay unit 200 and the nip-forming member N are on opposite sides of the holder 140, and the stay unit 200 supports the nip-forming member N via the holder 140. The stay unit 200 comprises a first stay 210 as an example of a stay, and a second stay 220 connected to the first stay 210 by means of a connecting member CM.

The first stay 210 is a member that supports the holder base 141 of the holder 140. The first stay 210 is made of metal or the like. The first stay 210 is located in a position shifted from a center of the nip region NP downstream in the moving direction. In other words, in the moving direction, a distance from the downstream end of the nip region NP to the first stay 210 is shorter than a distance from the upstream end of the nip region NP to the first stay 210. The first stay 210 comprises a base portion 211, and a hemmed portion HB formed by bending the material back on itself. The base portion 211 is located in a position shifted from the center of the nip region NP downstream in the moving direction.

The base portion 211 has, at one side thereof facing to the holder 140, a contact surface Ft that contacts the holder base 141 of the holder 140. The contact surface Ft is a flat surface perpendicular to the predetermined direction.

The base portion 211 having its length oriented parallel to the width direction comprises, at its both end portions, load-receiving portions 211A that receive forces from the biasing mechanism 300A (see FIG. 4) which will be described later. The load-receiving portion 211A provided at each end portion of the base portion 211 is configured to have a recess that opens on a side facing away from the nip-forming member N in a direction parallel to the predetermined direction. In other words, each end portion of the base portion 211 has a side facing away from the nip-forming number N in the direction parallel to the predetermined direction, and the load-receiving portion 211A is formed at that side of each end portion of the base portion 211.

A supporting member BF made of electrically conductive plastic is attached to the load-receiving portion 211A. The supporting member BF is a member which protects the base portion 211 made of metal and an arm 310 (see FIG. 4) which will be described later from rubbing against each other. The supporting member BF comprises a fit-on portion BF1 and a pair of leg portions BF2. The fit-on portion BF1 is configured to fit on the load-receiving portion 211A. Specifically, the fit-on portion BF1 has a holding portion BF5 (see FIGS. 7C, 9A) which contacts the load-receiving portion 211A of the base portion 211 when the supporting member BF fits on the load-receiving portion 211A. The leg portions BF2 are located at upstream and downstream sides in the moving direction, respectively, of each of the aforementioned end portions of the base portion 211. The fit-on portion BF1 is held between the first stay 210 and the arm 310 (see FIG. 5A). The holding portion BF5 is located in a position shifted from the center of the nip region NP downstream in the moving direction.

The belt guide G is a member that contacts the inside surface 131 to guide the belt 130. The belt guide G is made of plastic or other material having a heat-resisting property. The belt guide G comprises an upstream guide G1 and a downstream guide G2.

The slide sheet 150 is a rectangular sheet configured to reduce the frictional resistance between each pad P1, P2 and the belt 130. The slide sheet 150 is held at the nip region NP between the inside surface 131 of the belt 130 and each pad P1, P2. The slide sheet 150 is made of an elastically deformable material. It is to be understood that any material can be used for the slide sheet 150; herein, a sheet of plastic containing polyimide resin is adopted.

As shown in FIG. 2, the upstream guide G1, the downstream guide G2, and the first stay 210 are fastened together using a screw SC.

Figure 4:
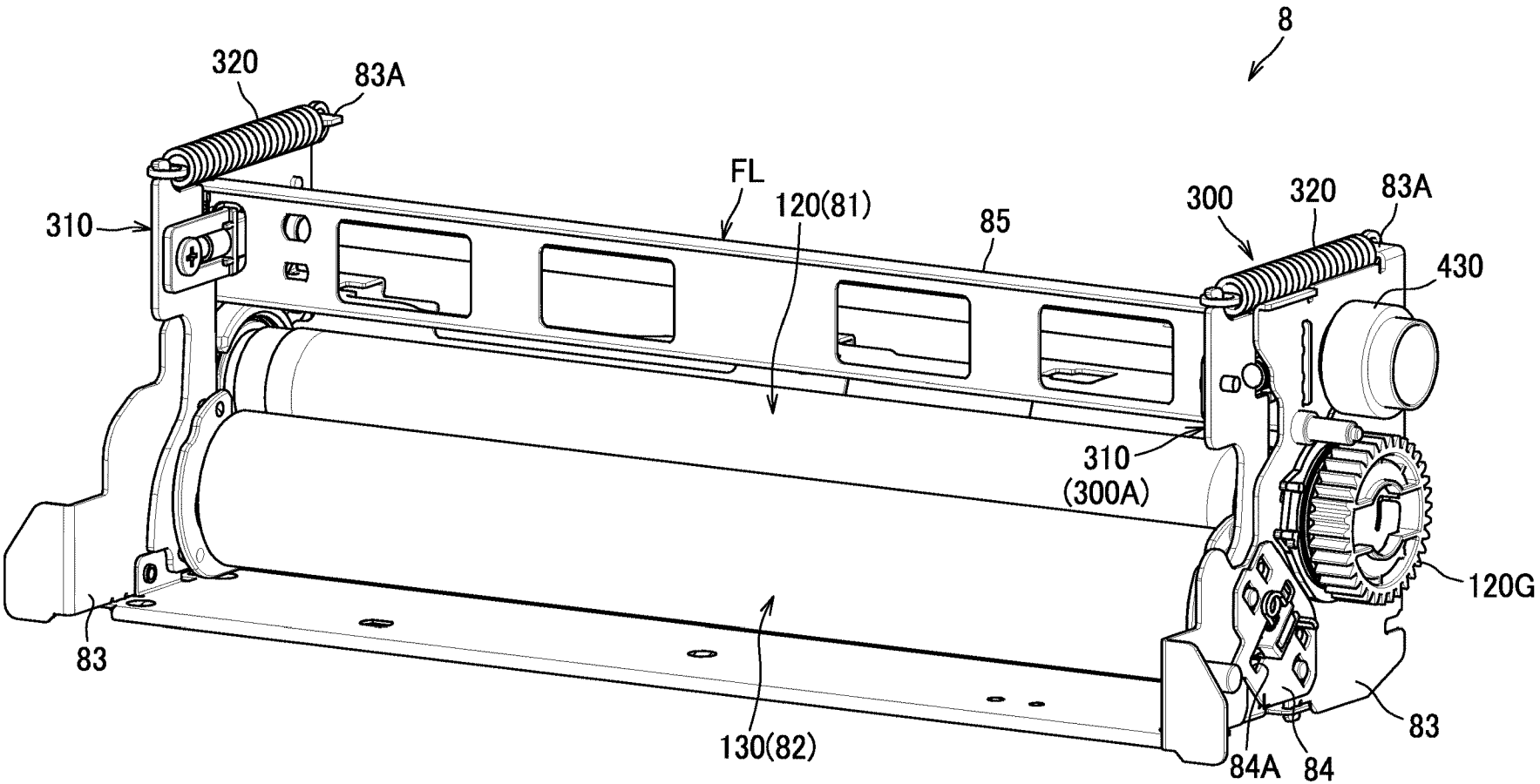
FIG. 4 is a perspective view of a variable pressure control mechanism.

As shown in FIG. 4, the fixing device 8 further comprises a frame FL and a variable pressure control mechanism 300. The frame FL is a frame that supports the first fixing member 81 and the second fixing member 82. The frame FL is made of metal, or the like. The frame FL comprises side frames 83, brackets 84, and a connecting frame 85. The side frames 83 and the brackets 84 are provided at both sides of the first fixing member 81 and the second fixing member 82 facing outward in the width direction. The connecting frame 85 is connected to the side frames 83.

The side frames 83 are frames that support the first fixing member 81 and the second fixing member 82. Each of the side frames 83 comprises a spring engageable portion 83A configured to be engageable with one end portion of a first spring 320 which will be described later.

The bracket 84 is a member that supports the second fixing member 82 in a manner that permits the second fixing member 82 to move along the predetermined direction. The bracket 84 is fixed to the side frame 83. To be more specific, the bracket 84 has a first slot 84A elongate in the predetermined direction. The first slot 84A supports the engagement portions 142, 143 of the holder 140 whereby the end portions of the first stay 210 with which the engagement portions 142, 143 are engaged are supported movably along the predetermined direction by the first slot 84A.

Figure 5A:
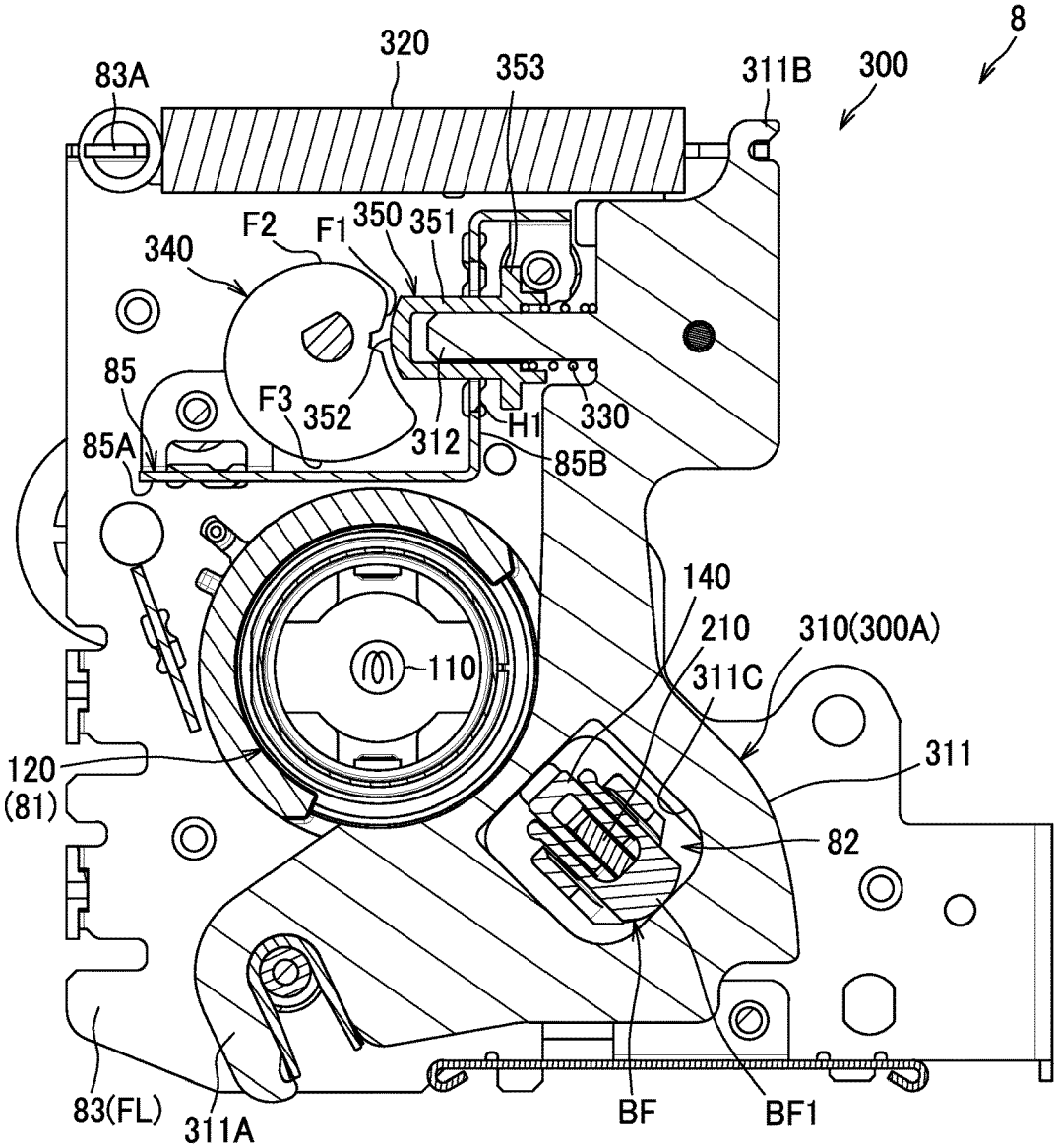
FIG. 5A is a section view of the variable pressure control mechanism in which a nip pressure is adjusted to a first pressure.
Figure 5B:
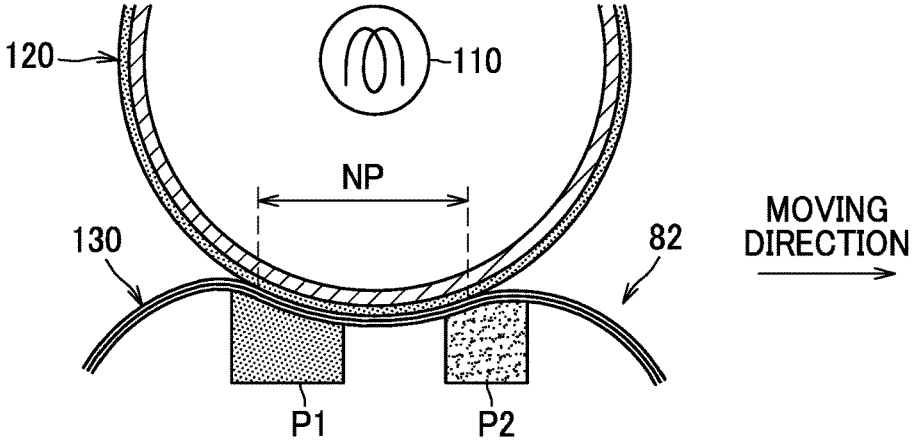
FIG. 5B is a section view showing a nip region, with its surrounding structural features, formed when the nip pressure takes on the first pressure.

The variable pressure control mechanism 300 is a mechanism configured to change a nip pressure exerted at the nip region NP. To be more specific, the variable pressure control mechanism 300 is configured to be capable of adjusting the nip pressure at the nip region NP to one of a first pressure, a second pressure smaller than the first pressure, and a third pressure smaller than the second pressure. As shown in FIG. 4 and FIG. 5A, the variable pressure control mechanism 300 comprises the aforementioned biasing mechanism 300A, a second spring 330, and a cam 340. The biasing mechanism 300A comprises an arm 310, and a first spring 320 as an example of a spring. The arm 310, the first spring 320, the second spring 330, and the cam 340 are provided at each of the ends of the frame FL facing outward in the width direction.

The arm 310 is a member configured to push the first stay 210 with the supporting member BF interposed between the arm 310 and the first stay 210. In actuality, the arm 310 pushes the supporting member BF which in turn pushes the first stay 210. Two arms 310 are configured to support the second fixing member 82, and are rotatably supported by the side frames 83.

The arm 310 comprises an arm body 311 and a cam follower 350. The arm body 311 is an L-shaped plate member made of metal or the like.

The arm body 311 comprises a first end portion 311A rotatably supported by the side frame 83, a second end portion 311B to which the first spring 320 is connected, and an engageable hole 311C in which the second fixing member 82 is supported. The engageable hole 311C is located between the first end portion 311A and the second end portion 311B, and is engaged with the supporting member BF. The supporting member BF is located on an inside of the engageable hole 311C.

The arm body 311 further comprises a guide protrusion 312 extending long toward the cam 340. The guide protrusion 312 is located closer to the second end portion 311B than to the first end portion 311A. More specifically, the guide protrusion 312 is located closer, than the engageable hole 311C, to the second end portion 311B. That is, the guide protrusion 312 is located between a first plane intersecting the second end portion 311B and a second plane intersecting the engageable hole 311C which planes are perpendicular to a straight line passing through the second end portion 311B and the engageable hole 311C.

The cam follower 350 is fitted on the guide protrusion 312 of the arm body 311 in a manner that permits the cam follower 350 to move relative to the guide protrusion 312. The cam follower 350 is contactable with the cam 340. The cam follower 350 is made of plastic or the like, and comprises a tubular portion 351, a contact portion 352, and a flange portion 353. The tubular portion 351 is a portion fitted on the guide protrusion 312. The contact portion 352 is provided at one end of the tubular portion 351. The flange portion 353 is provided at the other end of the tubular portion 351.

The tubular portion 351 is supported, by the guide protrusion 312, movably along a line parallel to the protruding direction of the guide protrusion 312. The contact portion 352 is a wall closing a cam 340 side open end of the tubular portion 351, and is located between the cam 340 and the extreme end of the guide protrusion 312. The flange portion 353 protrudes from the other end of the tubular portion 351 in radial directions perpendicular to a direction of movement of the cam follower 350.

A second spring 330 is disposed between the tubular portion 351 and the arm body 311. Accordingly, the arm body 311 is configured not only to be biased by the first spring 320 but also to be able to be biased by the second spring 330.

The first spring 320 is a spring exerting a first biasing force (tensile force) on the second fixing member 82. Specifically, the first spring 320 is configured to bias the arm body 311 toward the roller 120, to exert the first biasing force on the arm body 311 which in turn exerts the same first biasing force on the second fixing member 82; i.e., the first biasing force exerted on the arm body 311 acts via the arm body 311 on the second fixing member 82.

To be more specific, the biasing force of the first spring 320 is transmitted via the arm body 311, the supporting member BF, the first stay 210, and the holder 140, to thereby cause the upstream pad P1 and the downstream pad P2 to be biased toward the roller 120. The first spring 320 is a helical tension spring made of metal or the like, and has its one end connected to the spring engageable portion 83A of the side frame 83, and its other end connected to the second end portion 311B of the arm body 311.

The second spring 330 is a spring capable of exerting, on the second fixing member 82, a second biasing force (compression-resisting force) in a direction opposite to a direction of the first biasing force. Specifically, the second spring 330 is configured to be capable of exerting the second biasing force on the arm body 311 which in turn exerts the same second biasing force on the second fixing member 82; i.e., the second biasing force exerted on the arm body 311 acts via the arm body 311 on the second fixing member 82. The second spring 330 is a helical compression spring made of metal or the like, and is disposed between the tubular portion 351 and the arm body 311 with the guide protrusion 312 inserted in a space surrounded by the helical compression spring.

The cam 340 is a member capable of changing the compression state of the second spring 330 to a first compression state in which the second biasing force is not exerted on the second fixing member 82, to a second compression state in which the second biasing force is exerted on the second fixing member 82, and to a third compression state in which the second spring 330 is deformed more than in the second compression state. Moreover, the cam 340 also has a function of causing the second fixing member 82 to move against the biasing force of the first spring 320. The cam 340 is supported by the side frame 83 in a manner that allows the cam 340 to rotate to a first cam position shown in FIG. 5A, to a second cam position, and to a third cam position. The cam 340 is configured such that the nip pressure varies according to the cam position, and takes on the first pressure in the first cam position, the second pressure in the second cam position, and the third pressure in the third cam position. To be more specific, the cam 340 is caused to rotate from the first cam position to the third cam position by a motor (not shown) running in a forward direction, and to rotate from the third cam position to the first cam position by the motor running in a reverse direction.

The cam 340 is made of plastic or the like, and comprises an opposite surface F1, a first support surface F2, and a second support surface F3. The opposite surface F1, the first support surface F2, and the second support surface F3 are located on an outer surface (periphery) of the cam 340.

The opposite surface F1 is a surface that faces the cam follower 350 when the cam 340 is in the first cam position, i.e., where the nip pressure is the first pressure. When the cam 340 is in the first cam position, the opposite surface F1 is located apart from the cam follower 350.

The first support surface F2 is a surface that supports the cam follower 350 in such a manner that the second spring 330 is kept in the second compression state. The first support surface F2 contacts the cam follower 350 when the cam 340 is in the second cam position, i.e., where the nip pressure is the second pressure. To be more specific, the first support surface F2 comes in contact with the cam follower 350 when the cam 340 is caused to rotate from the first cam position approximately 90 degrees in the clockwise direction as in the drawing. The distance from the first support surface F2 to the center of rotation of the cam 340 is greater than the distances from the opposite surface F1 to the center of rotation of the cam 340.

The second support surface F3 is a surface that supports the cam follower 350 in such a manner that the second spring 330 is kept in the third compression state and the position of the arm body 311 is kept in a second position different from a first position shown in FIG. 5A. The second support surface F3 contacts the cam follower 350 when the cam 340 is in the third cam position, i.e., where the nip pressure is the third pressure. To be more specific, the second support surface F3 comes in contact with cam follower 350 when the cam 340 is caused to rotate from the first cam position approximately 270 degrees in the clockwise direction as in the drawing, in other words, when caused to rotate from the second cam position approximately 180 degrees in the clockwise direction as in the drawing. The distance from the second support surface F3 to the center of rotation of the cam 340 is greater than the distance from the first support surface F2 to the center of rotation of the cam 340.

When the cam 340 is in the first cam position, the cam 340 is positioned apart from the cam follower 350, and thus the second spring 330 is in the first compression state. In this state, where the cam 340 leaves the second spring 330 in the first compression state, the arm body 311 assumes the first position shown in FIG. 5A.

To be more specific, when the cam 340 leaves the second spring 330 in the first compression state, the second biasing force of the second spring 330 is not exerted via the arm body 311 on the second fixing member 82 because the cam 340 is positioned apart from the cam follower 350, so that only the first biasing force of the first spring 320 is exerted via the arm body 311 on the second fixing member 82. In this state where the first biasing force is exerted on the second fixing member 82 by the first spring 320 and the second biasing force is not exerted on the second fixing member 82 by the second spring 330, the nip pressure takes on the first pressure.

In this non-limiting example of the fixing device 8 illustrated herein, when the cam 340 leaves the second spring 330 in the first compression state, the second spring 330 is held in a deformed state between the cam follower 350 and the arm body 311. That is, the second spring 330 in the first compression state is not let be in its equilibrium length but deformed from its equilibrium length. It is understood that the second spring 330 even in such a deformed state does not exert its second biasing force on the second fixing member 82 because the cam 340 is apart from the cam follower 350.

The cam 340 comes in contact with the cam follower 350 and causes the cam follower 350 to move for a predetermined distance relative to the arm body 311 during the process of rotation from the first cam position shown in FIG. 5A to the second cam position, i.e., where the nip pressure is changed from the first pressure to the second pressure. Accordingly, the second spring 330 between the cam follower 350 and the arm body 311 deforms, and when the cam 340 has got positioned in the second cam position, the compression state of the second spring 33 changes to the second compression state in which the second spring 330 is deformed (compressed) more than in the first compression state.

When the cam 340 is positioned in the second cam position, the cam follower 350 is supported by the cam 340, so that the second biasing force of the second spring 330 is exerted via the arm body 311 on the second fixing member 82 in a direction reverse to the direction of the first biasing force. Therefore, where the first biasing force is exerted on the second fixing member 82 by the first spring 320 and the second biasing force is exerted on the second fixing member 82 by the second spring 330, the nip pressure takes on the second pressure smaller than the first pressure.

When the cam 340 causes the second spring 330 to assume the second compression state, the arm body 311 remains in the first position described above. It is to be understood that the downstream pad P2 is substantially not deformed when pressed against the roller 120, i.e., put under a load irrespective of its magnitude. As the downstream pad P2 is substantially not deformed, the positions of the stay unit 200 supporting the downstream pad P2, and the arm 310 supporting the stay unit 200 as well, remain substantially unchanged irrespective of the magnitude of the load. Moreover, the position of the upstream pad P1 depends on the position of the downstream pad P2, and thus remains unchanged, if the downstream pad P2 is substantially not deformed with its position unchanged accordingly. Therefore, the strong nip condition (under the first pressure) and the weak nip condition (under the second pressure) are not different from each other in terms of the entire nip width (distance from an entrance or upstream edge of the upstream nip region NP1 to an exit or downstream edge of the downstream nip region NP2), and the position of the arm 310 remains substantially unchanged between these nip conditions.

The reason that the downstream pad P2 is not deformed is that the hardness of the downstream pad P2 is sufficiently greater than the hardness of the upstream pad P1 and the hardness of the elastic layer 122 of the roller 120. To be more specific, the reason lies in that the downstream pad P2 is hard enough to resist nonnegligible deformation which would otherwise be caused by a required range of nip pressures from the maximum nip pressure (downstream nip pressure under the strong nip condition) to the minimum nip pressure (downstream nip pressure under the weak nip condition) to be produced at the downstream nip region NP2.

Conversely, the maximum nip pressure and the minimum nip pressure required to be produced at the downstream nip region NP2 are set at such levels that the downstream pad P2 is substantially not deformed.

Hereupon, it is to be understood that "the downstream nip P2 is substantially not deformed" connotes that the downstream nip P2 may be deformed to such a level that change in the nip width (dimension and position of the nip in the moving direction of the belt) of the downstream nip region NP2 formed by the downstream pad P2 would not affect the image quality and the sheet conveyance (i.e., the variation in the downstream nip width may not be zero).

Since the arm body 311 assumes the first position regardless of whether the second spring 330 is in the first compression state or in the second compression state as described above, both of the upstream pad P1 and the downstream pad P2 serve to hold the belt 130 so that the belt 130 is held between the upstream pad P1 and the roller 120 and between the downstream pad P2 and the roller 120, under the both nip conditions: the condition in which the nip pressure takes on the first pressure; and the condition in which the nip pressure takes on the second pressure. More specifically, the position of the second fixing member 82 relative to the roller 120 is substantially the same under the both conditions, and thus the width (dimension in the moving direction) of the nip region NP is substantially the same under the both conditions.

The cam 340 causes the cam follower 350 to further move relative to the arm body 311 to cause the cam follower 350 to contact the arm body 311 during the process of rotation from the second cam position to the third cam position, i.e., where the nip pressure is changed from the second pressure to the third pressure. Thereafter, the cam 340 further caused to rotate pushes the arm body 311 via the cam follower 350. Accordingly, the compression state of the second spring 330 changes to the third compression state in which the second spring 330 is deformed more than in the second compression state, and the arm body 311 is caused to rotate from the first position to the second position different from the first position.

To be more specific, in the first stage of the process of rotation of the cam 340 from the second cam position to the third cam position, the cam follower 350 moves relative to the arm body 311, and the contact portion 352 of the cam follower 350 approaches the extreme end of the guide protrusion 312. When the contact portion 352 comes in contact with the extreme end of the guide protrusion 312, the compression state of the second spring 330 changes to the third compression state. Accordingly, when the cam 340 causes the second spring 330 to assume the third compression state, the contact portion 352 that is part of the cam follower 350 is held between the cam 340 and the guide protrusion 312. In other words, the contact portion 352 not only contacts the cam 340 but also contacts the guide protrusion 312. Thereafter, the cam 340 further caused to rotate pushes the guide protrusion 312 via the contact portion 352, and the arm body 311 is thereby caused to rotate against the biasing force of the first spring 320 from the first position to the second position. In short, the cam 340 causes the first spring 320 to deform via the cam follower 350 and the arm body 311.

In this way, when the arm body 311 is in the second position, the second fixing member 82 is located in a position farther apart from the roller 120 than a position in which the second fixing member 82 is located when the arm body 311 is in the first position. Such change in the position of the second fixing member 82 relative to the roller 120 makes the width (dimension in the moving direction) of the nip region NP formed when the arm body 311 is in the second position smaller than that formed when the arm body 311 is in the first position, and the nip pressure is changed to the third pressure smaller than the second pressure. That is, the position of the arm 310 is changed by the cam 340 whereby the nip pressure and the nip width are changed. To be more specific, when the arm 310 is in the second position, the belt 130 is held only between the upstream pad P1 and the roller 120 but not held between the downstream pad P2 and the roller 120. Therefore, when the arm 310 is in the second position, the upstream nip pressure and the upstream nip width become smaller, and the downstream nip pressure becomes zero.

In the illustrated example, when the nip pressure takes on the third pressure, the upstream pad P1 serves to hold the belt 130, and the belt 130 is held between the upstream pad P1 and the roller 120; however, this configuration may not be essential for this implementation. As an alternative, the belt 130 may not be held between the upstream pad P1 and the roller 120 when the nip pressure takes on the third pressure. In this alternative example, the third nip pressure is zero.

Figure 6:
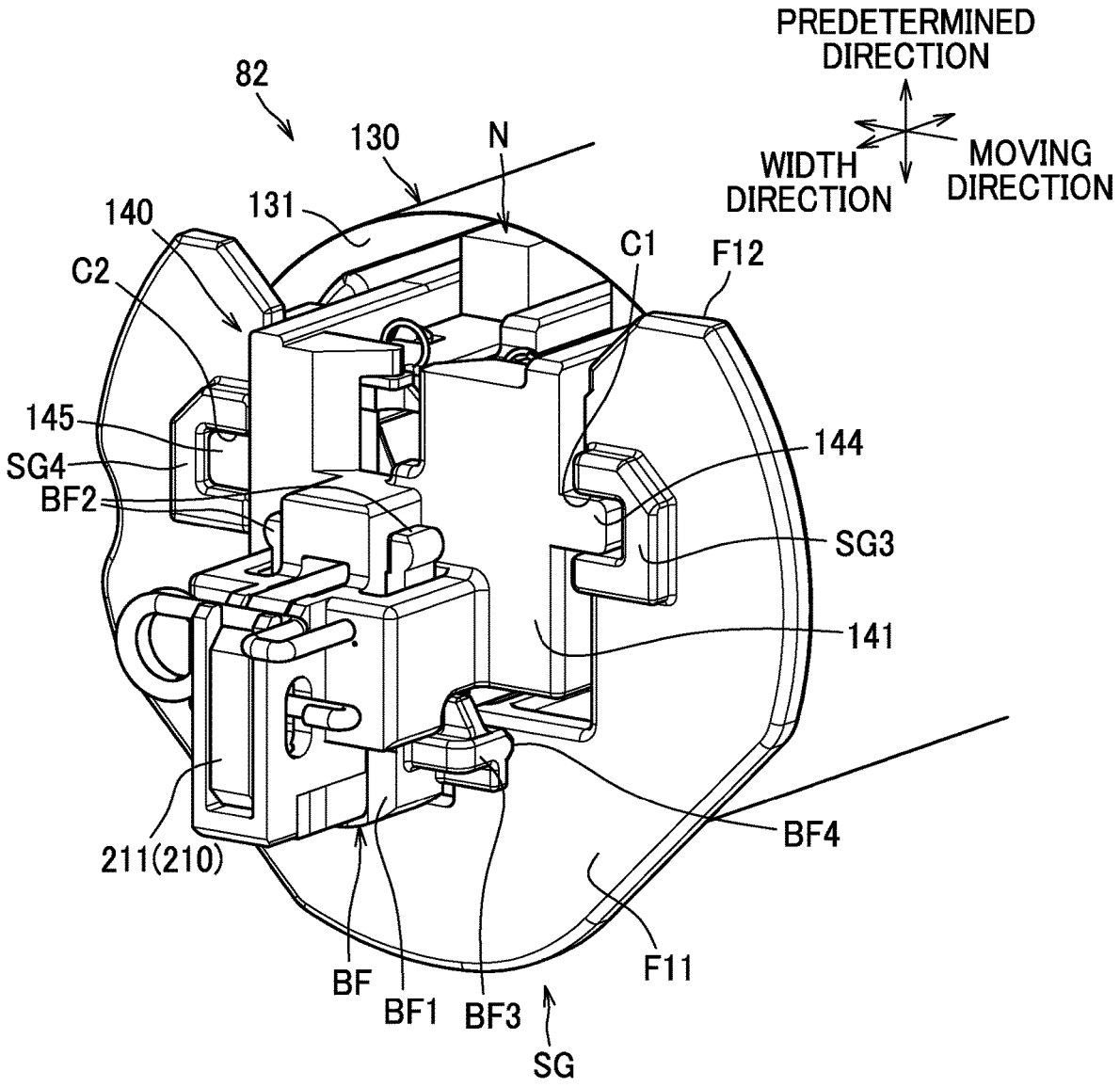
FIG. 6 is a perspective view showing a structure of a side end portion of a second fixing member as viewed obliquely from one of the sides facing in a direction of the width of the belt.

As shown in FIG. 6, the second fixing member 82 further comprises a side guide SG configured to guide a side end of the belt 130. The side guide SG is provided at each of the open sides of the belt 130. The side guide SG is supported by the holder 140 in a manner that permits the side guide SG to move in the width direction, specifically, in such a manner as to render the side guide SG swayable or rotatable on an axis parallel to the predetermined direction.

To be more specific, the holder 140 comprises an upstream protrusion 144 and a downstream protrusion 145. The holder 140 includes two end portions positioned near the open sides of the belt 130 (tubular endless belt) which open outward in the width direction. The upstream and downstream protrusions 144, 145 are provided in pair at each of the end portions of the holder 140. The upstream protrusion 144 protrudes from an upstream side surface of the holder base 141 upstream in the moving direction. The downstream protrusion 145 protrudes from a downstream side surface of the holder base 141 downstream in the moving direction.

The side guide SG comprises an upstream recess C1 in which the upstream protrusion 144 is engaged, and a downstream recess C2 in which the downstream protrusion 145 is engaged. Accordingly, the side guide SG is swayably supported by the holder 140.

The supporting member BF is located across the side guide SG from the belt 130 outward in the width direction. In other words, the supporting member BF and the belt 130 are located on opposite sides (as defined by an inside surface and an outside surface facing in directions parallel to the width direction) of the side guide SG. The supporting member BF is located on an outer side (on which the outer side surface F11 faces), that is opposite to an inner side (on which the end guide surface F12 faces), of the side guide SG. The supporting member BF has a Young's modulus equal to or greater than a Young's modulus of the side guide SG. Besides the fit-on portion BF1 and the pair of leg portions BF2 described above, the supporting member BF further comprises an extension portion BF3 and a protrusion BF4. The extension portion BF3 extends from the fit-on portion BF1 upstream in the moving direction. The protrusion BF4 protrudes from the extension portion BF3 toward the side guide SG.

The pair of leg portions BF2 sandwich part of the holder 140 and the base portion 211 (engaged with the holder 140) of the first stay 210. In other words, part of the holder 140 is interposed between each of the leg portions BF2 and the first stay 210. In this way, with the leg portions BF2 sandwiching the part of the holder 140 and the base portion 211, the supporting member BF is attached to the holder 140.

The protrusion BF4 and the side guide SG are arranged along the width direction and kept in contact with each other, so that the side guide SG is swayably supported on the protrusion BF4. More specifically, the protrusion BF4 contacts an outer side surface F11 of the side guide SG facing outward in the width direction. The outer side surface F11 is a surface of the side guide SG facing away from the belt 130. The protrusion BF4 in contact with the outer side surface F11 is contoured to provide a supporting point on which the side guide SG sways. As shown in FIG. 7C, the protrusion BF4 has a contact surface F21 which contacts the side guide SG. The contact surface F21 is an outwardly curved surface bulging toward the side guide SG. To be more specific, the contact surface F21 has a shape of a segment of a circle bulging toward the side guide SG in a cross section perpendicular to the predetermined direction, and also has a shape of a segment of a circle bulging toward the side guide SG in a cross section perpendicular to the moving direction.

Figure 9A:
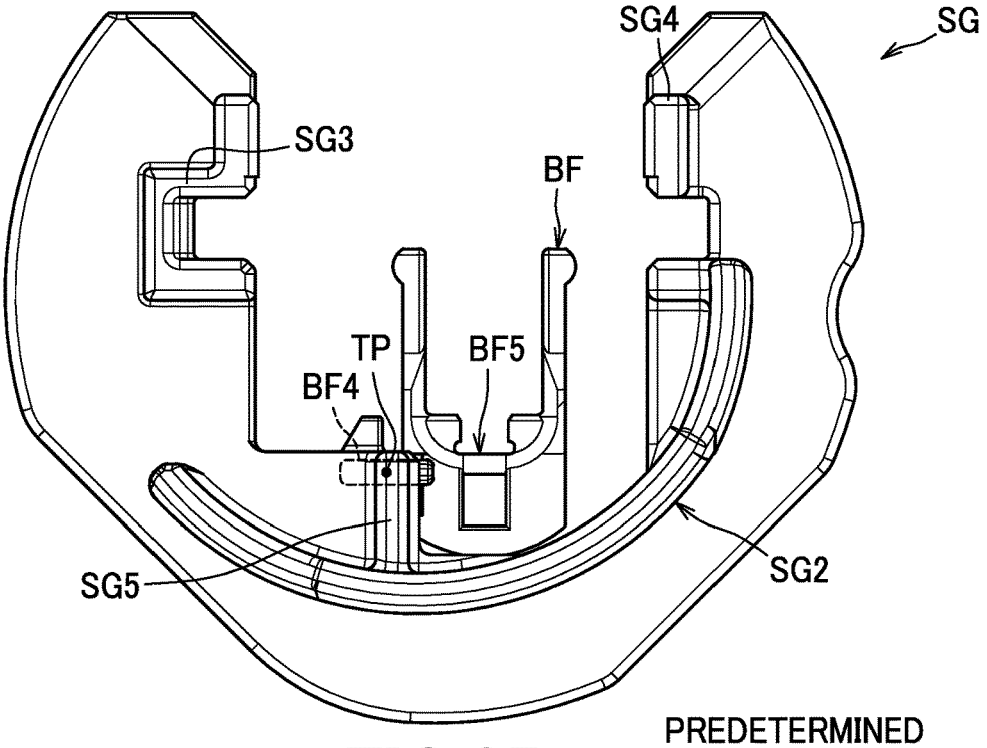
FIG. 9A shows relative positions and configurations of the side guide and the supporting member assembled together.
Figure 9B:
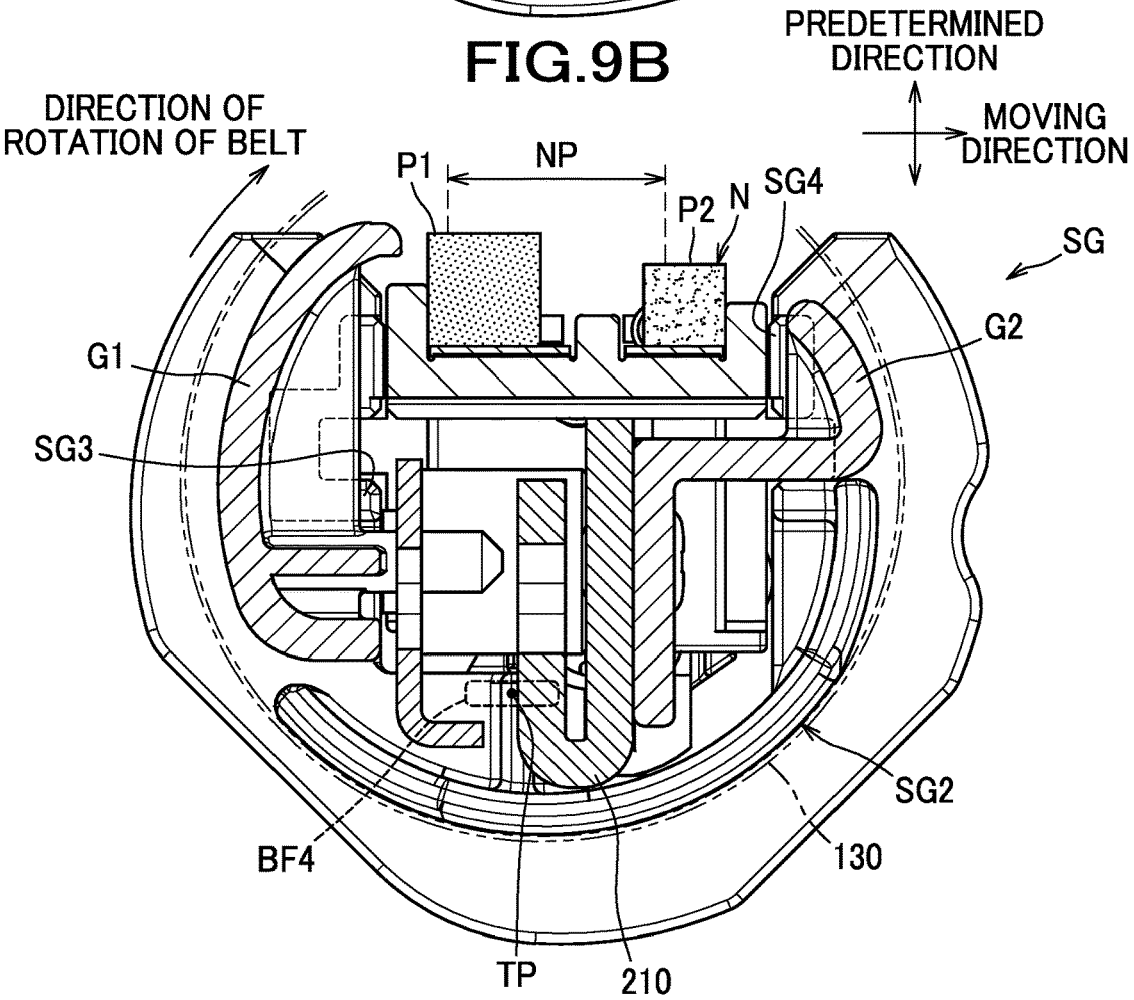
FIG. 9B shows relative positions and configurations of the side guide, the supporting member, the first stay, and associated structures as assembled together.

As shown in FIGS. 9A and 9B, a point TP of contact of the protrusion BF4 (contact surface F21) with the side guide SG is located on an inside of a trajectory of the belt 130 as viewed from the width direction and in a position shifted from the holding portion BF5 upstream in the moving direction.

Figure 7A:
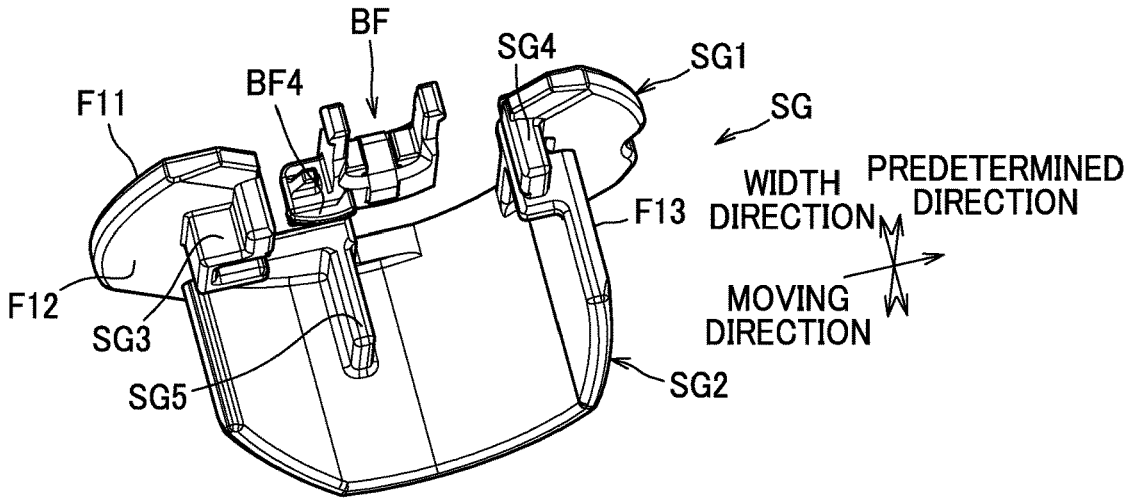
FIGS. 7A and 7B are perspective views showing a side guide and a supporting member.
Figure 7B:
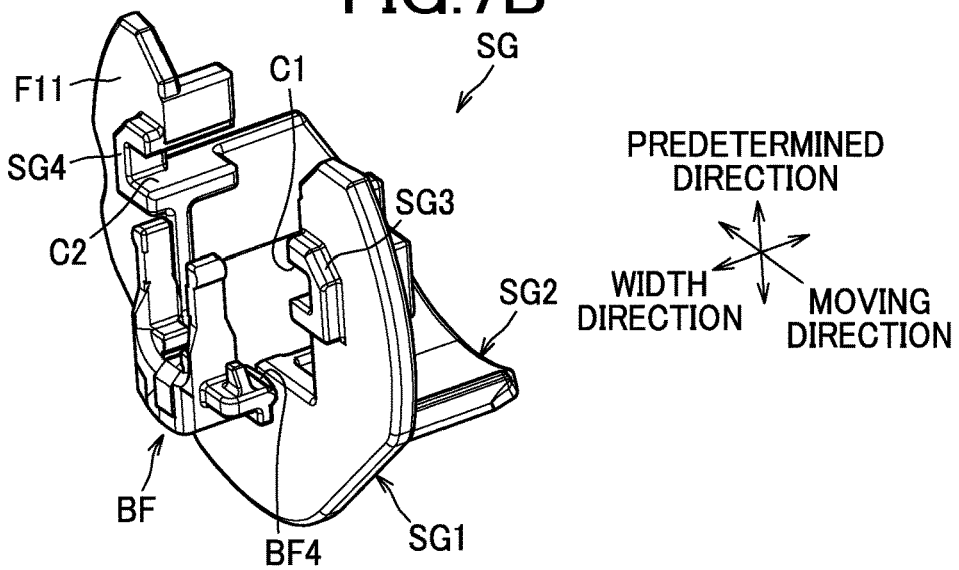
Figure 7C:
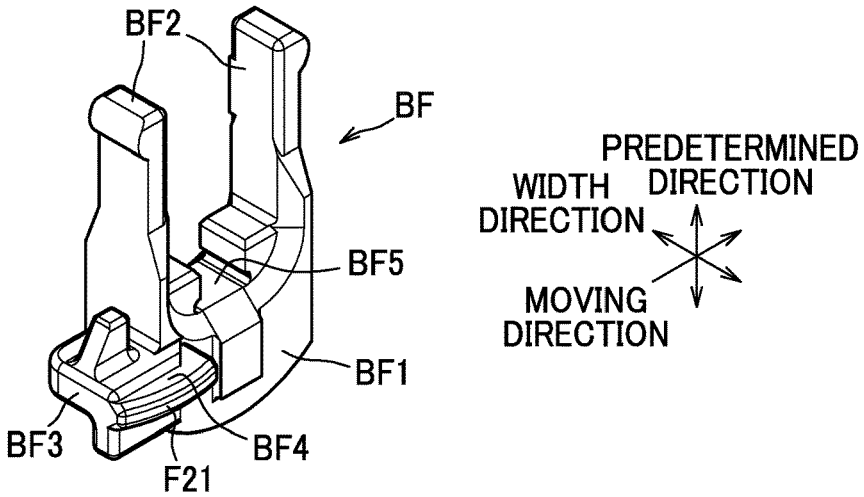
FIG. 7C is a perspective view showing the supporting member.

As shown in FIGS. 7A and 7B, the side guide SG comprises a plate portion SG1, a rib SG2, an upstream engagement portion SG3, and a downstream engagement portion SG4. The plate portion SG1 has the aforementioned outer side surface F11 provided thereon. The rib SG2 is configured to extend in a shape of a segment of a circle. The upstream engagement portion SG3 has the aforementioned upstream recess C1 provided therein. The downstream engagement portion SG4 has the aforementioned downstream recess C2 provided therein. The plate portion SG1 has an end guide surface F12 configured to guide a side end of the belt 130. The end guide surface F12 is a surface facing inward in the width direction, i.e., facing in the direction opposite to the direction in which the outer side surface F11 faces. The end guide surface F12 and the outer side surface F11 are opposite side surfaces of the plate portion SG1 oriented perpendicular to the width direction.

The rib SG2 has an inner guide surface F13 configured to guide an inside surface 131 of the belt 130. The inner guide surface F13 is an outside surface of the arc-shaped rib SG2. A reinforcement rib SG5 is provided on an inside surface of the arc-shaped rib SG2. The reinforcement rib SG5 extends from a portion of the plate portion SG1 in contact with the protrusion BF4 of the supporting member BF away from the protrusion BF4 inward in the width direction. The reinforcement rib SG5 and the point TP of contact of the protrusion BF4 (contact surface F21) with the side guide SG overlap each other when viewed in the width direction.

As shown in FIG. 9B, the rib SG2 spans the nip region NP from upstream to downstream throughout in the moving direction, more specifically, beyond a space defined by upstream and downstream edges of the nip region NP. The rib SG2 is located across the first stay 210 from the nip-forming member N. In the direction of rotation of the belt 130, the aforementioned upstream guide G1 is located downstream of the rib SG2, and the aforementioned downstream guide G2 is located upstream of the rib SG2.

Figure 8A:
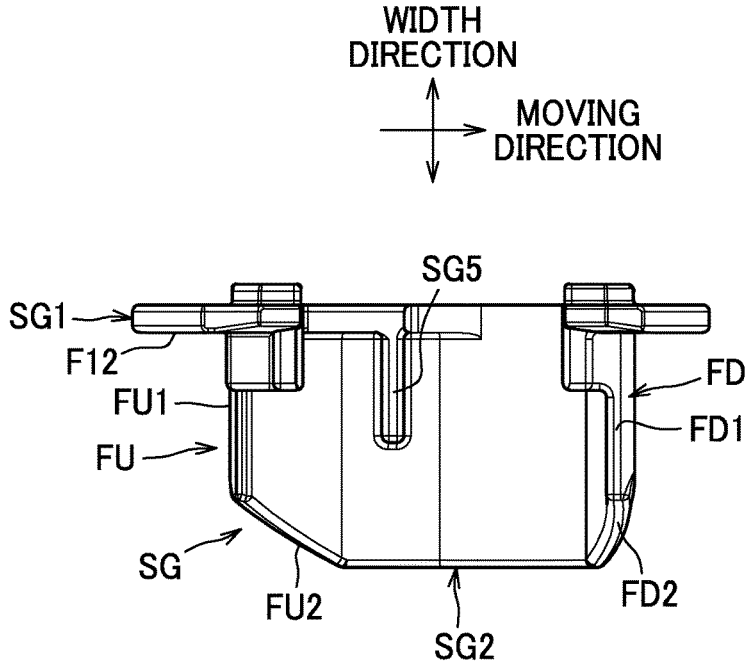
FIG. 8A shows the side guide as viewed from a predetermined direction (the direction in which the second fixing member is biased)
Figure 8B:
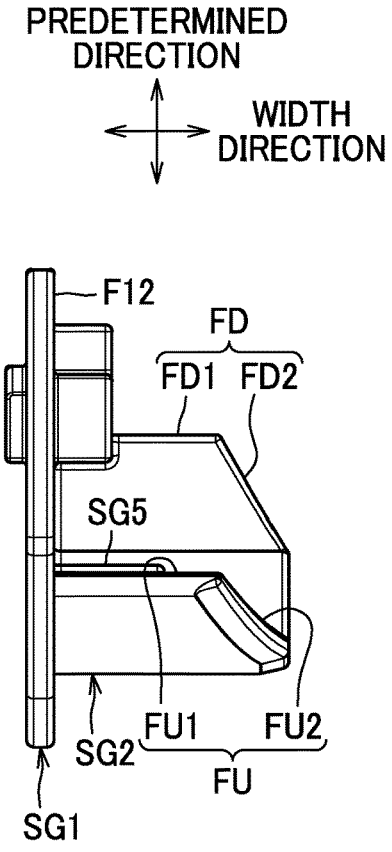
FIG. 8B shows the side guide as viewed from a moving direction (the direction of motion of the belt at the nip region)
Figure 8C:
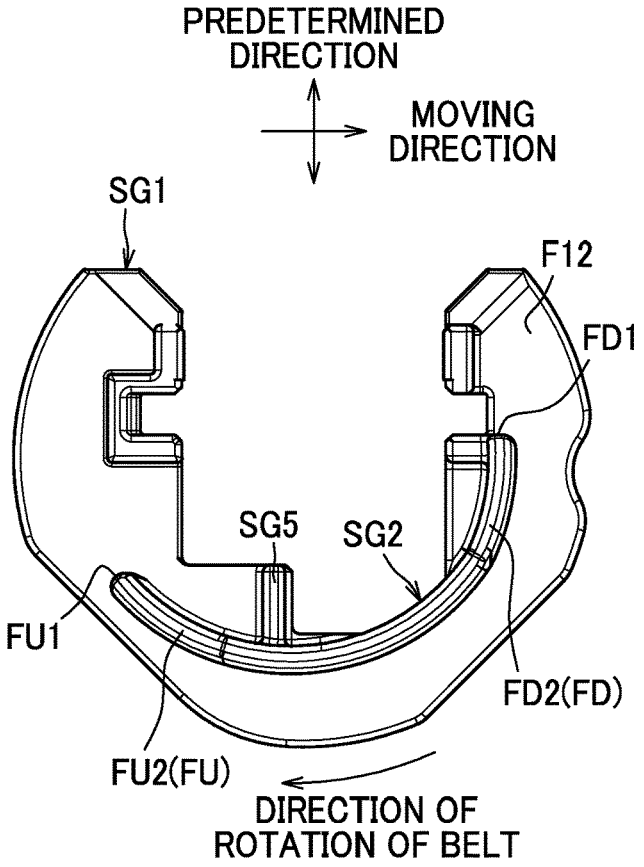
FIG. 8C shows the side guide as viewed from a width direction (the direction of the width of the belt)

As shown in FIGS. 8A and 8C, the rib SG2 has an upstream end face FU located at an upstream end in the moving direction, and a downstream end face FD located at a downstream end in the moving direction. The upstream end face FU comprises a perpendicular end face HA perpendicular to the end guide surface F12, and a slanting surface FU2 angled with respect to the end guide surface F12. The perpendicular end face HA extends from the end guide surface F12 parallel to the width direction. The slanting surface FU2 extends from an end of the perpendicular end face FU1 farthest from the end guide surface F12, upstream in the direction of rotation of the belt 130 obliquely in a direction away from the end guide surface F12

As shown in FIGS. 8B and 8C, the downstream end face FD comprises a perpendicular end face FD1 perpendicular to the end guide surface F12, and a slanting surface FD2 angled with respect to the end guide surface F12. The perpendicular end face FD1 extends from the end guide surface F12 parallel to the width direction. The slanting surface FD2 extends from an end of the perpendicular end face FD1 farthest from the end guide surface F12, downstream in the direction of rotation of the belt 130 obliquely in a direction away from the end guide surface F12. As shown in FIGS. 8A and 8B, each of the slanting surfaces FU2, FD2 is located apart from the end guide surface F12 in the width direction. The perpendicular end face FU1 connects the end guide surface F12 and the slanting surface FU2. The perpendicular end face FD1 connects the end guide surface F12 and the slanting surface FD2.

As shown in FIGS. 6, 7A and 7B, the upstream engagement portion SG3 and the downstream engagement portion SG4 are portions each having a shape of a letter U which opens on the holder 140. The upstream engagement portion SG3 and the downstream engagement portion SG4 are formed integrally with the plate portion SG1 in one piece, and protrude in a direction opposite to a direction in which the end guide surface F12 of the plate portion SG1 faces, beyond the outer side surface F1*l* of the plate portion SG1, and also protrude in a direction opposite to a direction in which the outer side surface F11 of the plate portion SG1 faces, beyond the end guide surface F12. Accordingly, the upstream recess C1 and the downstream recess C2 extend beyond the outer side surface F11 in a direction opposite to the direction in which the end guide surface F12 faces, and extend beyond the end guide surface F12 in a direction opposite to the direction in which the outer side surface F11 faces. As shown in FIG. 7A, a portion of the downstream engagement portion SG4 protruding from the end guide surface F12 has a shape of a letter U with its bottom cut away therefrom. However, this shape of the protruding portion of the downstream engagement portion SG4 is illustrated by way of example only, and may be modified in the complete shape of a letter U as of the upstream engagement portion SG3.

The upstream engagement portion SG3 and the downstream engagement portion SG4 may have predetermined dimensions sufficiently large in the width direction so that the side guide SG caused to sway would not come off the upstream protrusion 144 and the downstream protrusion 145 and the side guide SG would not rotate about an axis extending along the moving direction. If the upstream engagement portion SG3 and the downstream engagement portion SG4 having such predetermined dimensions are configured to protrude beyond the end guide surface F12 only, without protruding beyond the outer side surface F11, then the amounts of protrusion of the upstream engagement portion SG3 and the downstream engagement portion SG4 from the end guide surface F12 would disadvantageously be larger. To eliminate this disadvantage, the upstream engagement portion SG3 and the downstream engagement portion SG4 are herein configured to protrude from the outer side surface F11 so that the amounts of protrusion of the upstream engagement portion SG3 and the downstream engagement portion SG4 from the end guide surface F12 can be made smaller.

As shown in FIGS. 9A and 9B, the upstream engagement portion SG3 and the upstream guide G1 overlap each other, and the downstream engagement portion SG4 and the downstream guide G2 overlap each other. To be exact, the orthographic projections of the upstream engagement portion SG3 and the upstream guide G1 on a plane perpendicular to the width direction overlap each other. Similarly, the orthographic projections of the downstream engagement portion SG4 and the downstream guide G2 on a plane perpendicular to the width direction overlap each other. Since the amounts of protrusion of the upstream engagement portion SG3 and the downstream engagement portion SG4 from the end guide surface F12 are small as described above, the dimensions of the upstream guide G1 and the downstream guide G2 in the width direction can be made larger, so that the belt 130 can be guided stably by the upstream guide G1 and the downstream guide G2.

Figure 10A:
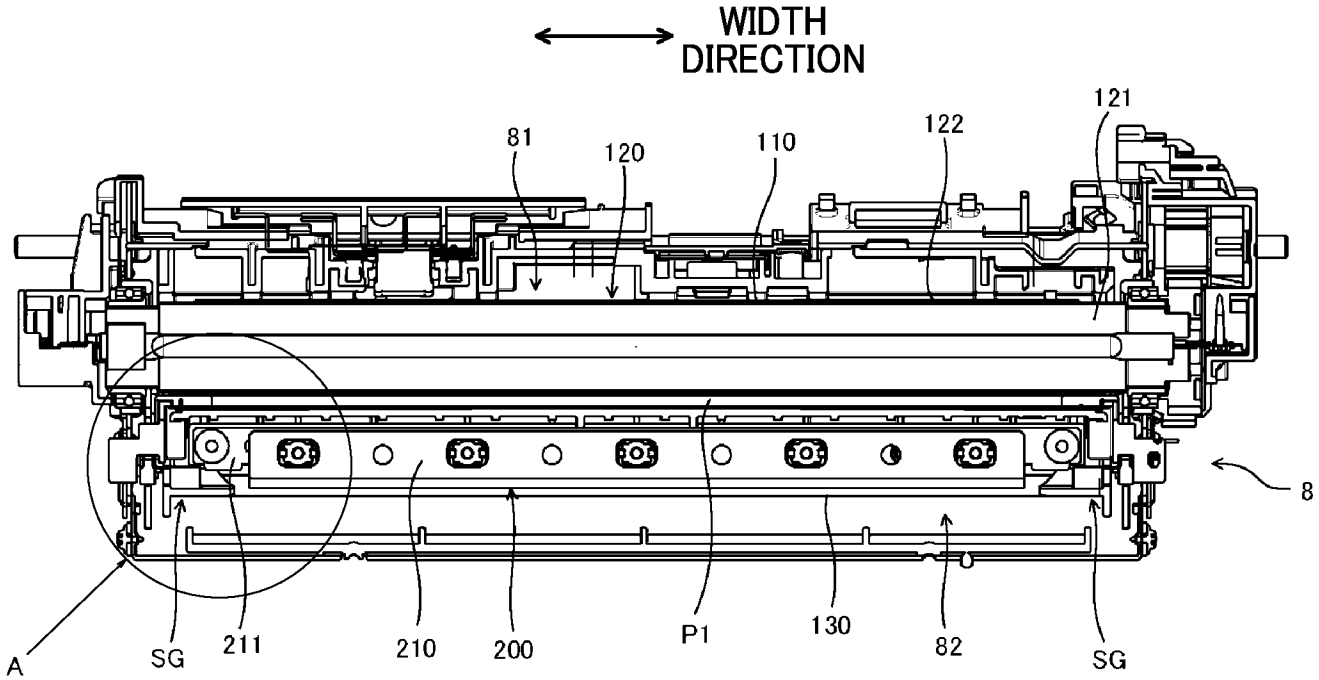
FIG. 10A is a sectional view spanning the entire width of the second fixing member as viewed from the moving direction.
Figure 10B:
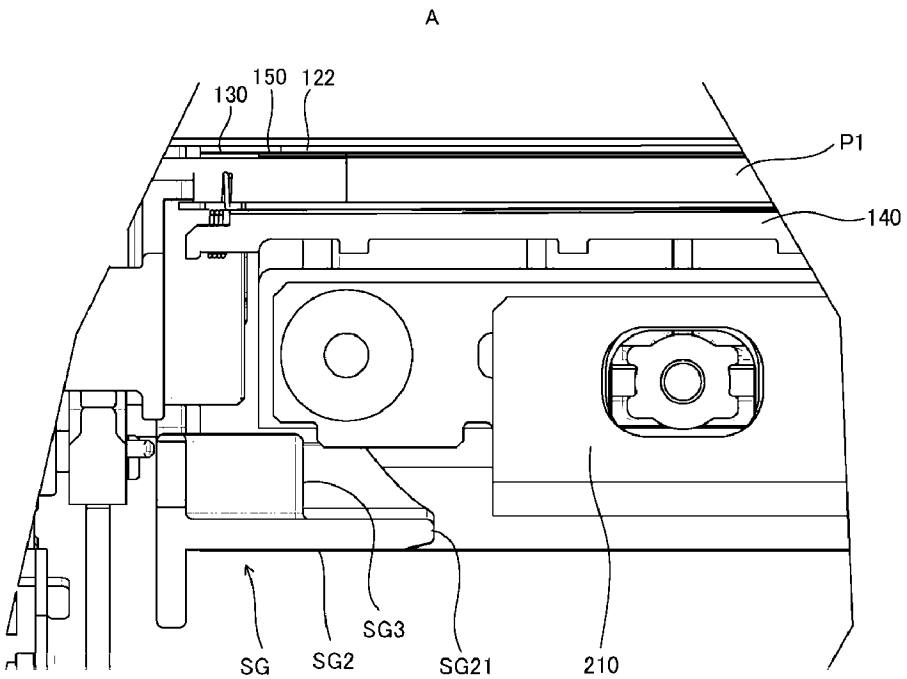
FIG. 10B is a partially enlarged sectional view showing a structure of an end portion of the second fixing member as viewed from the moving direction.
Figure 11:
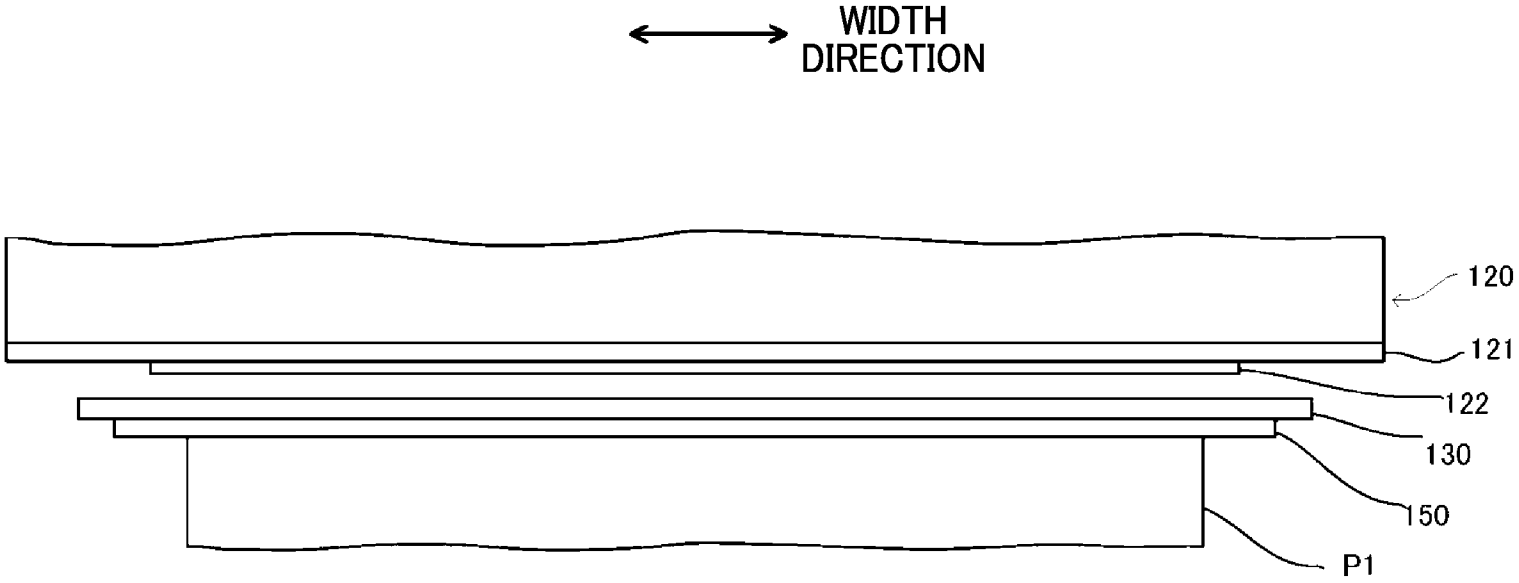
FIG. 11 is a schematic illustration showing relative lengths (dimensions in the width direction) of a belt, a slide sheet, a pad, and a tube blank and an elastic layer of a roller.

As shown in FIGS. 10A, 10B and 11, the length (dimension in the width direction) of the elastic layer 122 of the roller 120 is smaller than the width of the belt 130. The entire length of the elastic layer 122 of the roller 120 contacts the belt 130. In other words, the end portions of the outside surface of the belt 130 positioned near the open sides which open outward in the width direction include regions out of contact with the elastic layer 122 of the roller 120.

The length (dimension in the width direction) of the slide sheet 150 is smaller than the width of the belt 130. The entire length of the slide sheet 150 is located within the width of the belt 130. The length of the slide sheet 150 is greater than the lengths (dimensions in the width direction) of the upstream pad P1 and the downstream pad P2. Moreover, the length of the slide sheet 150 is greater than the length of the elastic layer 122 of the roller 120. The length of the elastic layer 122 of the roller 120 is greater than the lengths of the upstream pad P1 and the downstream pad P2.

When viewed in the predetermined direction, the rib SG2 overlaps the upstream pad P1 and the downstream pad P2. The side end of the belt 130 facing outward in the width direction is located closer than the inner end SG21 of the rib SG2 to the end guide surface F12. When viewed in the predetermined direction, the belt 130 is so located as to overlap the upstream engagement portion SG3 of the side guide SG.

The length (dimension in the width direction) of the holder 140 is greater than the lengths of the upstream pad P1 and the downstream pad P2. The length of the holder 140 is greater than the length of the slide sheet 150.

The following discussion focuses on the operation and advantages of the fixing device 8 described above.

As shown in FIG. 6, during the operation of the fixing device 8, when the belt 130 moves in the width direction, the side guide SG follows the motion of the belt 130 and sways on the protrusion BF4 of the supporting member BF as the supporting point. Accordingly, the wearing of the side end of the belt 130 resulting from strong collision against the side guide SG can be restrained.

When the protrusion BF4 serving as a supporting point on which the side guide SG is swayable is worn down with the long-term use of the fixing device 8, a serviceperson removes from the holder 140 the supporting member BF located at the outside of the side guide SG, and replaces with a new supporting member BF. In this operation, removal of the side guide SG from the belt 130 would not be required. Accordingly, the problems associated with the replacement of the side guide SG, such as alteration of the easy-to-slide property of the inside surface 131 of the belt 130 can be restrained.

Furthermore, additional labor and time to be necessitated for the purpose of restraining alteration of the easy-to-slide property of the inside surface 131 of the belt 130 caused by reduction of grease taken away with the side guide SG, such as replenishing grease, etc. can be saved. Since the point TP of contact of the protrusion BF4 (contact surface F21) with the side guide SG is located, on an inside of a trajectory of the belt 130 as viewed from the width direction, and positioned upstream of the first stay 210 in the moving direction, the point TP of contact can be located near the center of the nip region NP in the moving direction, so that the side guide SG can be kept in balance while rendered swayable in a stable manner.

Since the Young's modulus of the supporting member BF is equal to or greater than the Young's modulus of the side guide SG, the side guide SG is made less likely to wear down than the supporting member BF, so that the replacement of the side guide SG is less likely to become required.

Since the supporting member BF is electrically conductive, the first stay 210 can be grounded via the supporting member BF.

Since the upstream engagement portion SG3 and the downstream engagement portion SG4 protrude in a direction opposite to the direction in which the end guide surface F12 faces, beyond the outer side surface F11, the upstream recess C1 and the downstream recess C2 can be elongated while the upstream engagement portion SG3 and the downstream engagement portion SG4 are restrained from interfering with the upstream guide G1 and the downstream guide G2. Accordingly, the side guide SG can be restrained from rotating about an axis parallel to the moving direction.

Since the upstream end face FU and the downstream end face FD of the rib SG2 of the side guide SG comprise slanting surfaces FU2, FD2, respectively, angled with respect to the end guide surface F12, the step of inserting the side guide SG in the belt 130 in the assembly process of the fixing device 8 can be performed easily because interference of the rib SG2 with the slide sheet 150 and/or other members inside the belt 130, which would make the inserting of the side guide SG difficult, can be restrained.

Since the slanting surfaces FU2, FD2 are located apart from the end guide surface F12, the inner guide surface F13 can be designed to be larger in size, as compared, for example, with an alternative configuration in which one end of the slanting surface is located on the end guide surface. Therefore, undesirable buckling of the belt 130 due to a small-size inner guide surface F13 can be restrained.

Since the end portions of the outside surface of the belt 130 has regions kept out of contact with the elastic layer 122 of the roller 120, grease run off from the ends of the belt 130 would be restrained from getting deposited on the elastic layer 122 of the roller 120.

Since the entire length of the slide sheet 150 is positioned within the width of the belt 130, grease is restrained from running across the slide sheet 150 and flowing out of the belt 130, and the amount of grease run off from the ends of the belt 130 can be reduced.

Since the rib SG2 overlaps the upstream pad P1 and the downstream pad P2 as viewed from the predetermined direction, the rib SG2 for guiding the belt 130 with a longer dimension in the width direction can be provided in the fixing device reduced in size in the width direction as compared with an alternative configuration in which the rib SG2 and the upstream and downstream pads P1, P2 do not overlap each other, and the buckling of the belt 130 can be restricted.

The above-described embodiment may be implemented in various other forms as described below.

Although the rib SG2 provided with two slanting surfaces FU2, FD2 respectively at upstream and downstream end faces FU, FD in the moving direction is illustrated above as an exemplary configuration, the rib may be provided at one end face only, i.e., upstream or downstream in the moving direction. Although the slanting surfaces FU2, FD2 separated apart from the end guide surface F12, respectively, by the perpendicular end faces FU1, FU2, connection of the slanting surfaces FU2, FD2 to the end guide surface F12 may not be made by the perpendicular end faces FU1, FU2, but may be made by surfaces that are not perpendicular to the end guide surface F12, or may be made by curved surfaces, or may be made directly.

The variable pressure control mechanism 300 comprising the first spring 320 and the second spring 330 are described above, but the second spring 330 may be not be provided in the variable pressure control mechanism. In this alternative configuration, the cam follower 350 may also be omitted, and the cam 340 may be configured to push the arm body 311 directly.

The image forming apparatus may not be a laser printer, and may be a printer with an LED-type exposure device, a copier, a multifunction machine, or the like.

The first spring and the second spring may not be a helical spring as described above, and a torsion spring, a leaf spring, etc. may be used, instead.

Although the fixing device 8 described above uses a heater 110, the fixing device which uses no heater may also be feasible. The fixing device may be a device configured to apply light to the nip region to thereby fix a developer image onto a sheet.

A halogen lamp illustrated as an example of a heater may be substituted, for example, by a carbon heater.

Although the upstream pad P1 and the downstream pad P2 described above are both made of rubber, the pads may be made, for example, of plastic, metal or other hard material resistant to deformation even under pressure.

Although the first fixing member is exemplified by the tubular or cylindrical roller in which the heater 110 is disposed, the first fixing member may be a pressure roller comprising a shaft and a rubber layer formed around the shaft. An endless belt of which an inner side is heated by a heater may also be used, instead. An external heating scheme in which a heater is disposed outside the first fixing member to heat an outer surface of the first fixing member, or an induction heating scheme known in the art may also be adopted. Another alternative configuration in which a heater is provided in the second fixing member to indirectly heat the first fixing member in contact with the outer periphery of the second fixing member may also be feasible. Each of the first fixing member and the second fixing member may be configured to incorporate a heater. It is to be understood that where the first fixing member is configured as a pressure roller, the nip-forming member may be configured as a nip plate or a flat-plate heater which is configured to hold the belt in combination with the pressure roller where the belt is held between the plate-shaped nip-forming member and the pressure roller.

The elements described in the above embodiment and its modified examples may be implemented selectively and in combination.

What is claimed is:

1. A fixing device comprising:

a roller;

a pressure unit configured to form a nip in combination with the roller, the pressure unit comprising:

a belt configured to contact the roller in a nip region;

a pressure pad configured to press the belt in combination with the roller;

a side guide comprising an end guide surface, and an inner guide surface, the end guide surface being configured to guide a side end of the belt, the inner guide surface being configured to guide an inside surface of the belt; and a stay configured to support the pressure pad;

an arm configured to press the pressure unit toward the roller; and a supporting member located on an outer side of the side guide that is opposite to an inner side on which the end guide surface faces, the supporting member being held between the stay and the arm, the supporting member comprising a contact surface which contacts the side guide and on which the side guide is swayably supported.

2. The fixing device according to claim 1, wherein the contact surface is an outwardly curved surface that bulges toward the side guide.

3. The fixing device according to claim 1, wherein the supporting member comprises a holding portion which holds the stay, and wherein a point of contact of the contact surface with the side guide is located in a position shifted from the holding portion upstream in a moving direction of the belt at the nip region.

4. The fixing device according to claim 3, wherein the holding portion is located in a position shifted from a center of the nip region downstream in the moving direction.

5. The fixing device according to claim 1, wherein the supporting member has a Young's modulus equal to or greater than a Young's modulus of the side guide.

6. The fixing device according to claim 1, wherein the supporting member is made of plastic.

7. The fixing device according to claim 1, wherein the stay and the arm are made of metal.

8. The fixing device according to claim 1, wherein the supporting member is electrically conductive.

9. The fixing device according to claim 1, wherein the arm further comprises an engageable hole in which the pressure unit is supported, wherein the supporting member is located on an inside of the engageable hole.

10. The fixing device according to claim 1, wherein the pressure unit further comprises a holder which is supported by the stay and by which the pressure pad is supported, the holder comprising:

an upstream protrusion protruding upstream in a moving direction of the belt at the nip region; and a downstream protrusion protruding downstream in the moving direction, wherein the side guide further comprises:

an upstream engagement portion having an upstream recess in which the upstream protrusion is engaged; and a downstream engagement portion having a downstream recess in which the downstream protrusion is engaged.

11. The fixing device according to claim 10, wherein the side guide further comprises an outer side surface facing away from the end guide surface, and wherein the upstream engagement portion and the downstream engagement portion protrude in a direction opposite to a direction in which the end guide surface faces, beyond the outer side surface.

12. The fixing device according to claim 11, wherein the side guide further comprises:

a rib extending in a shape of a segment of a circle, to form the inner guide surface; and a reinforcement rib provided on a surface, opposite the inner guide surface, of the rib, wherein the reinforcement rib and a point of contact of the contact surface with the side guide overlap each other when viewed in a direction of a width of the belt.

13. The fixing device according to claim 1, wherein the side guide further comprises a rib extending in a shape of a segment of a circle, to form the inner guide surface, and wherein the rib has upstream and downstream end faces facing upstream and downstream in the moving direction respectively, and at least one of the upstream and downstream end faces comprises a slanting surface angled with respect to the end guide surface.

14. The fixing device according to claim 13, wherein the at least one of the upstream and downstream end faces comprises a perpendicular end face extending perpendicular to the end guide surface, and wherein the perpendicular end face connects the end guide surface and the slanting surface.

15. The fixing device according to claim 1, wherein the pressure pad comprises:

an upstream pad, the belt being held between the upstream pad and the roller; and a downstream pad located downstream relative to the upstream pad in a direction of conveyance of a sheet, the belt being held between the downstream pad and the roller, and wherein the pressure unit further comprises a holder by which the upstream pad and the downstream pad are supported.

16. A fixing device comprising:

a roller;

a pressure unit configured to form a nip in combination with the roller, the pressure unit comprising:

a belt configured to contact the roller in a nip region;

a pressure pad configured to press the belt in combination with the roller;

a side guide comprising an end guide surface, the end guide surface being configured to guide a side end of the belt; and a stay configured to support the pressure pad;

an arm configured to press the pressure unit toward the roller; and a supporting member located on an outer side of the side guide that is opposite to an inner side on which the end guide surface faces, the supporting member being held between the stay and the arm, the supporting member comprising a contact surface which contacts the side guide and on which the side guide is swayably supported, wherein the supporting member is electrically conductive.

17. The fixing device according to claim 16, wherein the pressure pad comprises:

an upstream pad, the belt being held between the upstream pad and the roller; and a downstream pad located downstream relative to the upstream pad in a direction of conveyance of a sheet, the belt being held between the downstream pad and the roller, and wherein the pressure unit further comprises a holder by which the upstream pad and the downstream pad are supported.

18. A fixing device comprising:

a roller;

a pressure unit configured to form a nip in combination with the roller, the pressure unit comprising:

a belt configured to contact the roller in a nip region;

a pressure pad configured to press the belt in combination with the roller;

a side guide comprising an end guide surface, the end guide surface being configured to guide a side end of the belt; and a stay configured to support the pressure pad;

an arm configured to press the pressure unit toward the roller; and a supporting member located on an outer side of the side guide that is opposite to an inner side on which the end guide surface faces, the supporting member being held between the stay and the arm, the supporting member comprising a contact surface which contacts the side guide and on which the side guide is swayably supported, wherein the pressure unit further comprises a holder which is supported by the stay and by which the pressure pad is supported, the holder comprising:

an upstream protrusion protruding upstream in a moving direction of the belt at the nip region; and a downstream protrusion protruding downstream in the moving direction, wherein the side guide further comprises:

an upstream engagement portion having an upstream recess in which the upstream protrusion is engaged; and a downstream engagement portion having a downstream recess in which the downstream protrusion is engaged.

19. The fixing device according to claim 18, wherein the side guide further comprises an outer side surface facing away from the end guide surface, and wherein the upstream engagement portion and the downstream engagement portion protrude in a direction opposite to a direction in which the end guide surface faces, beyond the outer side surface.

20. The fixing device according to claim 18, wherein the pressure pad comprises:

an upstream pad, the belt being held between the upstream pad and the roller; and a downstream pad located downstream relative to the upstream pad in a direction of conveyance of a sheet, the belt being held between the downstream pad and the roller, and wherein the holder supports the upstream pad and the downstream pad.

* * * * *